United States Patent [19]

Graham

[11] Patent Number: 4,820,364

[45] Date of Patent: Apr. 11, 1989

[54] METHOD FOR SEALING CAPSULES

[75] Inventor: Dean M. Graham, Hobart, N.Y.

[73] Assignee: Capsulbond Incorporated, Hobart, N.Y.

[21] Appl. No.: 497,449

[22] Filed: May 23, 1983

[51] Int. Cl.[4] ..... B65B 7/28

[52] U.S. Cl. ..... 156/69; 53/900; 156/274.8; 156/294; 156/305; 206/528; 206/530; 428/916

[58] Field of Search ..... 53/471, 485, 399, 900; 156/69, 213, 274.8, 294, 305; 206/528, 530; 426/138; 428/916

[56] References Cited

U.S. PATENT DOCUMENTS 3,071,513 1/1963 De Boer et al. ..... 53/485 X 3,164,508 1/1965 Marcey ..... 156/274.8

*Primary Examiner*—Robert A. Dawson

*Attorney, Agent, or Firm*—Klauber & Jackson

[57] ABSTRACT

The present invention relates to a method for sealing capsules to render them both tamper-proof and tamper-evident. The method comprises locating a quantity of an adhesion-promoting fluid between the adjacent surfaces of the overlapping capsule wall, and thereafter applying dielectric heat energy in the vicinity of the adhesion-promoting fluid, to cause the adjacent surfaces of the capsule walls to form a permanent bond. Preferably, the adhesion-promoting fluid may comprise a non-solvent for the capsule walls that further has a high dielectric constant. Suitable adhesion-promoting fluids include lower alkanols. The method is capble of rapid operation and is inexpensive by virtue of its simplicity. Reliable capsule seals are achieved that are incapable of violation.

19 Claims, No Drawings

METHOD FOR SEALING CAPSULES

BACKGROUND OF THE INVENTION

1. Field of the Invention The present invention relates to the preparation of capsules, particularly those that may contain edible ingredients, that comprise telescopically engaged capsule halves, and more specifically to a method for sealing such capsules to render them tamper-proof and tamper-evident.

2. Description of the Prior Art The capsules with which the present invention is concerned are well known and have been in broad use for many years. Such capsules are generally prepared from an edible natural substance such as gelatin, and are generally cylindrical telescopically engaging tubes, each tube having one end thereof sealed, so that upon coaxial disposition, they are capable of holding a quantity of material. Generally, such capsules are utilized in the pharmaceutical and food industries, to hold edible and pharmaceutically active materials such as medicines, vitamin preparations, and other edibles both solid and liquid. Generally, the materials from which the capsules are prepared are hydrophilic, and thereby adapted to dissolve in the intestine after ingestion.

One of the difficulties that has long been encountered in the use of such capsules as stated, has been their ability and occasional tendency to disengage from each other, whereby the contents of the capsule escape and are lost. Accordingly, the prior art is replete with numerous approaches directed to the maintenance of the sealing engagement between the capsule halves.

The problem of the disengagement of the capsule halves from each other has recently become more acute, in view of the well publicized deliberate disassembly of certain encapsulated medicaments and the inclusion therein of certain poisons such as cyanide. This deliberate act was successfully accomplished because the capsules were inadequately sealed and gave no evidence of their tampering. That is, the slip fit engagement between the capsule halves was easily disrupted and the cap part of the capsule was removed, so that the intruder was able to insert a small but lethal quantity of poison or other disruptive agent therein.

The events described above have spurred a renewed interest on the part of the industry and the public at large to develop methods and associated apparatus to render these capsules tamper-proof by the placement of appropriate indicators of tampering on the capsule. One such approach to this problem has been known for some time, and is disclosed in U.S. Pat. No. 1,861,047. In this patent, a circular band of hardened gelatin is disposed about the seam that occurs between the respective capsule halves comprising the body and the cap part that receives it. The application of the hardened gelatin band is presumed to act as a capsule seal and tamper indicator, to indicate when the capsule parts have been separated so that evidence of tampering is visually apparent.

The procedure outlined in the '047 patent and the capsules treated thereby have been found to be deficient, however, as it was possible to separate the body part from the cap part, modify the contents thereof and thereafter replace the cap and body parts in position against each other and reband the rejoined capsule so as to avoid detection of tampering.

Further deficiencies in the aforementioned technique relate to the material used to form the band. Generally, gelatin is utilized and it is found that the application thereof is difficult to control, with the result that the bands initially applied are frequently irregular, split, intermittent in extent and generally non-uniform in appearance. Also, the application of the gelatin band tends to introduce moisture into the capsule contents which in the instance of most capsule ingredients causes instability, and correspondingly drastically reduces shelf life of the contents. Likewise, if the drying system utilized in conjunctinn with the application of the gelatin band fails to function properly, excessive wetting of the capsule at the site of the band and consequent capsule deformation, particularly after large quantities of capsules are discharged into a holding drum, in accordance with conventional manufacturing practice, accentuates capsule deformation and results in increased numbers of capsule rejects.

Another bonding technique in broad use presently, is essentially a branding procedure, wherein a heated probe is applied against the outer surface of the capsule cap portion with sufficient pressure to urge it against the adjacent wall of the capsule body, and to cause both to melt superficially and thereby bond to each other.

This technique has the drawback that it frequently causes capsule deformation, by virtue of the localized heating which can contribute to increased frequency of capsule rejects. Likewise, the nature of the bond formed by this procedure is extremely local and renders the capsule vulnerable to undetectable violation, as with a scalpel or needle probe, to facilitate disengagement of the capsule halves for introduction of an adulterant.

Both of the aforementioned techniques are also inefficient and costly, as the equipment in the instance of the banding technique, is extremely expensive and limited in its rate of output. Likewise, the equipment utilized in the branding technique is complex, as one must have in addition to the branding equipment, a separate low speed machine for the purpose of holding the capsules during the branding process.

From the foregoing, it is evident that the need for an inexpensive, efficient and reliable capsule sealing technique exists. It is therefore to the fulfillment of this need that the present invention is directed.

SUMMARY OF THE INVENTION

In accordance with the present invention, a method is disclosed for sealing telescopically engaging capsules prepared as capsule halves with a capsule body and a capsule cap located thereover. The method comprises locating a quantity of an adhesion promoting fluid between the adjacent overlapping surfaces of the capsule body and the capsule cap in an assembled capsule; applying dielectric energy to the capsule in the vicinity of the adhesion-promoting fluid, the dielectric energy applied at a level and in an amount that is sufficient to bond the adjacent overlapping surfaces of the capsule body and the capsule cap to each other; and thereafter cooling the thus treated capsules to permit an integral, permanent bond and seal to form between the adjacent surfaces of the capsule halves.

The adhesion promoting fluid may be selected from heat sensitive edible adhesive dispersions and emulsions, and high dielectric constant liquids. Specific high dielectric constant liquids that work particularly well comprise the lower alkanols, with methanol and ethanol useful per se, and isopropanol optimally useful in an aqueous solution.

After the adhesion-promoting fluid is disposed interstitially between the adjacent surfaces of the overlapping capsule halves, the capsules may be washed with an appropriate washing fluid, to remove excess adhesion-promoting fluid from the capsule surfaces. Suitable washing fluids include non-solvents for the capsule walls, such as carbon tetrachloride, hexane, petroleum ether and the like. Thereafter the washed capsules may be dried to evaporate away the washing fluid. Drying may be conducted by several techniques.

The capsules are thereafter exposed to dielectric energy, such as microwave radiation, to cause heating to occur. In the instance where the adhesion-promoting fluid is a high dielectric constant liquid, dielectric heating causes the solvation of the adjacent surfaces of the overlapping capsule halves and the intermixing of the liquified capsule materials to occur, so that when the capsules are cooled, a firm, weld-like bond will form.

After exposure to dielectric energy is completed, the capsules may be cooled to permit final hardening of the bond between the adjacent capsule halves. In the instance where it is believed that additional liquid resides in the capsules after dielectric heating, the capsules may be post-treated to remove such liquid by a variety of known drying techniques, such as heating by infrared radiation or exposure to air or vacuum drying.

In the instance whereit is desired to encapsulate liquid materials, the present method may be repeated a plurality of times to ensure that a full and sufficient bond has formed between the respective capsule halves. By this method, liquids may be stably encapsulated in hard gelatin capsules, a process previously limited to soft elastic capsule technology.

The present method is interdisciplinary in its origins, and provides an inexpensive and rapid approach to the preparation of capsules that are both tamper-proof and tamper-evident. The integral nature of the bond formed between the respective capsule halves renders the capsules inviolate, in that any attempts to dislodge the respective capsule halves from each other will result in total capsule fracture and disintegration. Moreover, the simplicity of the foregoing technique is susceptible of speeds of operation wherein, for example, up to one million capsules may be sealed per hour. This may be specifically achieved by use of a machine devised for this purpose, that forms a part of co-pending application Ser. No. 503,950 (now abandoned), the disclosure of which is incorporated herein by reference.

Accordingly, it is a principal object of the present invention to provide a method for sealing telescopically assembled capsules.

It is a further object of the present invention to provide a method as aforesaid that results in a permanent bond between the respective overlapping capsule halves.

It is a further object of the present invention to provide a method as aforesaid that results in a tamper-proof and tamper-evident seal between the respective capsule halves.

It is a still further object of the present invention to provide a method as aforesaid that is rapid and efficient in practice.

It is a yet further object of the present invention to provide a method as aforesaid that achieves a reduction in the cost of capsule sealing.

Other objects and advantages will become apparent to those skilled in the art from a review of the ensuing detailed description.

DETAILED DESCRIPTION

In accordance with the present invention, a method is disclosed for sealing telescopically assembled capsules, which renders them both tamper-proof and tamper-evident. Such capsules are often constructed with a generally cylindrical capsule body and a corresponding cyclindrical capsule cap disposed thereover. The method comprises locating a quantity of an adhesion-promoting fluid interstitially between the adjacent overlapping surfaces of the capsule body and capsule cap. Thereafter, dielectric energy is applied to the capsules in the vicinity of the adhesion promoting fluid, at a level and in an amount that is sufficient to form a bond between the adjacent overlapping surfaces.

The present invention is predicated upon the discovery that certain non-solvents for capsule wall materials such as gelatin can infiltrate the interstitial, annular space between the respective overlapping capsule walls by capillary action. In particular, a group of fluids possessing this capability have been discovered and investigated, and it has been determined that these fluids when applied to the capsule surface adjacent the seam or junction between the capsule cap and the capsule body, will travel under the seam and between the respective capsule halves without requiring external motivation of any kind. Likewise, application of a quantity of the adhesion promoting fluid to one of the contiguous surfaces prior to the assembly of the capsule halves would not be necessary. The migration of the adhesion-promoting materials occurs rapidly as well, and thereby contributes to the efficiency and speed of the present method.

Suitable adhesion-promoting fluids may be selected from a variety of liquid substances, and include both dispersions and emulsions of adhesives for the particular capsule walls, and liquids having high dielectric constants. Of the materials useful herein, the latter group is preferred.

A variety of high dielectric constant liquids are available, however certain liquids have been found to be operable herein. Specifically, the lower alkanols, methanol, ethanol and isopropanol are exemplary. Each of these liquids is a non-solvent for gelatin, which is the conventional material from which capsule walls are prepared. The operability of these materials is particularly surprising, in view of tests that were conducted with other igh dielectric constant fluids such as dimethyl formamide, dimethyl sulfoxide and dimethyl acetamide, none of which fostered bonding under the circumstances and environment of the present method.

Other adhesion-promoting materials may be utilized, and, for example, one may employ a gelatin emulsion in an alkanol which, when heated, will cause an interstitial bond to develop in the instance of a gelatin capsule construction. Naturally, a variety of capsule materials and corresponding edible adhesives are known, and the present invention is not limited to specific materials in its scope.

Of the high dielectric constant materials, methanol and ethanol may be applied directly, while isopropanol is preferably applied in an aqueous solution. More particularly, isopropanol may be applied in a solution of from about 10% to about 20% of water, an preferably from about 15% to about 20% of water.

The lower alkanols may be prepared and employed in various mixtures. In particular, the lower alkanols may be prepared in mixtures with various hydrocarbons, such as lower alkanes, and low boiling point ethers. For example specific mixtures may include methanol and carbon tetrachloride, methanol and hexane, and methanol and a low boiling point petroleum ether. In the event that the latter mixtures are used, they may be prepared in the following respective ratios: 75% methanol-25% carbon tetrachloride; 50% methanol-50% hexane; and, 50% methanol-50% low boiling point petroleum ether. Naturally, the foregoing mixtures and the specifically enumerated mixing ratios are exemplary only, and are offered herein in fulfillment of the obligation to disclose a best mode for the practice of the invention. The present method is believed to extend in scope to other materials, their combinations and mixing ratios.

The adhesion-promoting materials may be applied to the capsules by spraying, or the capsules may be dipped in a quantity thereof. The infiltration of the adhesion-promoting materials in accordance with the present method is almost instantaneous (e.g. milliseconds for methanol), and, in the instance of capsule dipping, residence time may be a brief as 0.5 seconds for most liquids used. Wetting agents such as benzalkonium chloride or dioctyl sodium sulfosuccinate can accelerate infiltration.

In a particular embodiment, the adhesion-promoting fluid is located between the adjacent surfaces of the capsule halves, by the application of the above-enumerated liquids immediately followed by the application of a second fluid that is a non-solvent for the capsule material, and a solvent for the first-applied liquid. The second fluid is blocked from entering the interstitial space by the first fluid but effectively washes the first fluid off the capsule surface thereby minimizing possible damage to capsules bearing printing inks thereon, leaching of dye from capsule walls, and peeventing interbonding of adjacent capsules during application of dielectric energy.

Suitable second or auxiliary fluids may be selected from lower hydrocarbons such as carbon tetrachloride, hexane, low boiling point ethers and th like. Of these, carbon tetrachloride is most frequently used because of its low flammability.

After the adhesion-promoting material is located between the overlapping adjacent walls of the capsule halves, the capsules are then preferably washed with an appropriate washing fluid, to remove excess adhesion-promoting fluid from the outer surfaces. In some instances, the adhesion-promoting fluids may have to be washed away with the carrier fluid of the adhesion promoting fluid, then washed with a third fluid to remove the carrier fluid, leaving a surface film of a sublimable washing fluid selected to prevent undue capsule damage during subsequent processing. Suitable washing fluids may be selected from the group consisting of low molecular weight hydrocarbons, such as lower alkane and substituted alkanes, lower boiling point ethers such as petroleum ether, and others. In particular, carbon tetrachloride and hexane may be used herein.

After the capsules are appropriately washed, they are preferably dried at a temperature sufficient to volatize and thereby evaporate the washing fluids. Generally, drying at this stage may be conducted in an air tunnel or a linear oven with temperatures on the order of 90° to 100° C., with a corresponding residence time on the order of 1 minute or less.

Thereafter, the dried capsules may be exposed to dielectric energy, such as by microwave heating or the like, so that the adjacent overlapping capsule surfaces in the vicinity of the adhesion-promotigg fluid will form a bond with each other. In the instance where the adhesion-promoting fluid is one having a high dielectric constant, the application of dielectric heat energy causes the adjacent wall surfaces to solvate and intermix, so that, upon solidification, a integrated bond is formed. Generally, the dielectric heating can vary in energy level, with levels of 10 to 15 kW found to sufficient to accomplish the required solvation and resulting bonding of the capsule surfaces, for up to 1 million capsules per hour.

After dielectric heating is completed, the capsules may be fed directly into a holding container or hopper, for storage or final packaging, as in most instances, the capsules emerge from exposure to dielectric energy fully solidified and properly bonded with all interstitial fluids evaporated. In the instance where it is believed that residual liquid remains in the capsules, they may be subjected to a further drying cycle, by means of circulating air, by exposure to vacuum, by infrared heat or by other techniques known for removal of traces of moisture or solvents from drugs or food stuffs. The exact technique employed is not critical and may vary herein.

In certain instances, where the capsules have been dyed with a particular color and are further identified with an inked imprint, each of which are susceptible to degradation in contact with any or all of the adhesion-prmmoting fluids, auxiliary fluids or washing fluids, the present method may be modified to minimize and in most instances, eliminate ink and dye degradation due to solubilization. In such instances, the adhesion-promoting fluid, and the other fluids utilized in the present method may be chilled to temperatures on the order of −20° C. or lower. While the adhesion-promoting fluid and its auxiliary fluid may require such treatment, the washing fluid generally does not, and may accordingly be utilized at room temperature. The exact temperature of the various fluids, including the washing fluid, however, may vary to suit specific situations and materials.

As mentioned earlier, certain of the adhesion-promoting fluids are prepared as mixtures. For example, mixtures of methanol and carbon tetrachloride, hexane and low boiling point petroleum ether were recited above. Of these, it was found that the mixture carbon tetrachloride and methanol was very effective in preventing solvation of the particularly sensitive printing ink and dye, utilized with the capsules containing Tylenol®, manufactured by the McNeil Laboratories Division of Johnson & Johnson Incorporated. In this particular situation, the red dye and the black ink imprint were highly soluble in the alcohol utilized as the adhesion-promoting fluid. The mixture of 25% methanol-75% carbon tetrachloride was employed for this product, and proved capable of being applied to the capsules without marring or otherwise degrading either the red color or the ink imprint. This mixture was promptly washed with carbon tetrachloride as part of the infiltration procedure, and this particular sequence was successful. It was found that, during the dielectric heating of the capsules, the carbon tetrachloride prevented the solubilization of the red dye and slowed down the evaporation of the adhesion-promoting fluid disposed interstitially between the capsule cap and the capsule body, due to the higher boiling point of carbon tetrachloride by contrast with methanol. This prevented what had been previously observed as a staining or blushing of the opaque white capsule body, which had resulted consistently from the application of methanol individually as the adhesion-promoting fluid. A mixture of 50% methanol, 50% hexane was likewise an effective and safe bonding fluid for Tylenol®.

The present invention can be seen to be simple and inexpensive, as the materials and energy input are favorably reduced over comparable factors attending the practice of the known sealing processes. As mentioned earlier, and as recited in co-pending application Ser. No. 503,950 (now abandoned), a particular machine may be utilized that will optimally achieve the sealing of as many as one million capsules per hour.

As an example of the commercial practice of the present method, the unsealed capsules would be disposed in a vibrating hopper, from which they would be dispensed onto a moving conveyor belt. The capsules would then be passed through a spray treatment station where the adhesion-promoting fluid would be applied, and after which the washing fluid promptly applied thereover. The capsules would continue through a hot air tunnel where they would be quickly dried and ready for dielectric heating. The capsules would then be discharged onto a belt of a radio frequency apparatus where dielectric heating would be applied, and prompt bonding of the contiguous capsule walls would be achieved. In most instances, the capsules promptly emerging from dielectric heating would be dry and fully bonded, and could be conveyed to a storage bin for further processing or packaging.

While the present process is known to result in thorough and complete bonding of the capsule walls to each other, the process is sufficiently rapid in operation that the capsules may be subjected to repeated treatment if desired, to assure more thorough bonding of the capsule walls to each other. An example of a situation where multiple treatments may be appropriate is the sealing of capsules containing various liquids. In such instance, no more than two or three consecutive treatments would be necessary to provide a fluid-tight bond between hhe capsule halves; however, plural treatments are contemplated in accordance with the present invention.

A variety of liquids, among them peanut oil, polyethylene glycol, propylene glycol, dioxane, and the surfactant TWEEN 80® have been encapsulated and sealed in accordance with this method. The sealed capsules were then exposed to temperatures of 80° C. for extended periods of time without evidence of fluid loss or leakage.

This invention may be embodied in other forms or carried out in other ways without departing from the spirit or essential characteristics thereof. The present disclosure is therefore to be considered as in all respects illustrative, the scope of the invention being indicated by the appended claims, and all changes which come within the meaning and range of equivalency are intended to be embraced therein.

What is claimed is:

1. A method for sealing telescopically assembled capsules comprising a capsule body, and a capsule cap disposed in overlapping relationship thereover, said method consisting essentially of:

A. forming an assembled capsule by placing said capsule cap telescopically over said capsule body;

B. locating a quantity of an adhesion-promoting fluid interstitially between the adjacent overlapping surfaces of said capsule body and said capsule cap, wherein said adhesion-promoting fluid is a liquid that possesses a high dielectric constant, is a nonsolvent for the material constituting said capsule body and said capsule cap, and possesses a boiling point below the melting point of said material; and C. applying dielectric energy to the capsules having said adhesion-promoting fluid disposed interstitially between said capsule body and said capsule cap, said dielectric energy applied in the vicinity of said adhesion-promoting fluid at a level and in an amount sufficient to form a bond between said adjacent overlapping surfaces by the solvation of said surface with said adhesion-promoting fluid, but insufficient to cause the melting of said adjacent overlapping surfaces.

2. The method of claim 1 wherein said adhesion-promoting fluid is applied to said capsules in accordance with Step B by spraying thereon.

3. The method of claim 1 wherein said adhesion-promoting fluid is applied to said capsules in accordance with Step B by dipping said capsules in a quantity of said adhesion-promoting fluid.

4. The method of claim 1 wherein said adhesion-promoting fluid is located in accordance with Step B by:

A. applying said adhesion-promoting fluid to the exterior of said capsule at the junction between said capsule body and said capsule cap; and B. applying thereto a second auxiliary fluid to said capsule at said junction to enhance the rate at which said adhesion-promoting fluid is interstitially located between said overlapping surfaces.

5. The method of claim 4 wherein said auxiliary fluid is applied to said junction immediately after the application of said adhesion-promoting fluid.

6. The method claim 4 wherein said auxiliary fluid is selected from the group consisting of carbon tetrachloride, low molecular weight hydrocarbons, low boiling point petroleum ethers, and mixtures thereof.

7. The method of claim 1 wherein, after Step B, said capsules are washed to remove excess adhesion-promoting fluid from their outer surfaces.

8. The method of claim 1 wherein said adhesion-promoting fluid is selected from the group consisting of lower alkanols, aqueous solutions thereof, solutions of alkanols with hydrocarbons, solutions of alkanols with low boiling point ethers, and mixtures thereof.

9. The method of claim 8 wherein said adhesion-promoting fluid is selected from the group consisting of methanol, ethanol, an aqueous solution of isopropanol, a solution of methanol and carbon tetrachloride, a solution of methanol and hexane, and a solution of methanol and petroleum ether.

10. The method of claim 9 wherein said adhesion-promoting fluid is selected from the group consisting of a solution of 75% methanol and 25% carbon tetrachloride, a solution of 50% methanol and 50% hexane, and a solution of 50% methanol and 50% petroleum ether.

11. The method of claim 7 wherein said washing fluids are selected from the group consisting of carbon tetrachloride, low molecular weight hydrocarbons, low boiling point petroleum ethers and mixtures thereof.

12. The method of claim 11 wherein said washing fluid comprises hexane.

13. The method of claim 7 wherein said capsules are dried after washing and before the application of said dielectric energy, at a temperature and for a time sufficient to evaporate said washing fluid therefrom.

14. The method of claim 1 wherein said dielectric energy is applied at a level ranging between 10 and 15 kW per million capsules per hour.

15. The method of claim 1 further including drying said capsules after the application of said dielectric energy to remove any residual liquids therefrom.

16. The method of claim 1 wherein said method is repeated a plurality of times.

17. The method of claim 16 wherein said method is repeated from 2 to 3 times.

18. The method of claim 16 wherein liquids are sealed within the capsules.

19. The method of claim 4 wherein said adhesion-promoting fluid and said auxiliary fluid are maintained at a temperature no higher than −20° C. and are thereby applied to said capsules.

* * * * *